US006460949B2

(12) United States Patent
Jung

(10) Patent No.: US 6,460,949 B2
(45) Date of Patent: Oct. 8, 2002

(54) CABINET FOR WASHING MACHINE

(75) Inventor: Dong-San Jung, Siheung (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/725,953

(22) Filed: Nov. 30, 2000

(65) Prior Publication Data

US 2002/0008448 A1 Jan. 24, 2002

(30) Foreign Application Priority Data

Jul. 20, 2000 (KR) ..... 2000-41608

(51) Int. Cl.[7] ..... A47K 1/04
(52) U.S. Cl. ..... 312/228; 248/638; 68/23.1
(58) Field of Search ..... 312/228, 228.1; 248/638; 428/221; 68/23.7, 23.1

(56) References Cited

U.S. PATENT DOCUMENTS 4,307,588 A 12/1981 Smith et al.
5,855,353 A * 1/1999 Shaffer et al. ..... 248/638

FOREIGN PATENT DOCUMENTS

EP 0 791 676 A2 * 8/1997
JP 10249438 * 9/1998

* cited by examiner

*Primary Examiner*—Lanna Mai
*Assistant Examiner*—Jerry A. Anderson
(74) *Attorney, Agent, or Firm*—Larson & Taylor PLC

(57) ABSTRACT

A cabinet for a washing machine including a vibration-proof plate attached to the front panel to reduce vibrations. A recess is provided to the vibration-proof plate's lower part, and a recess is formed on the front panel's lower part corresponding to the recess of the plate. A plurality of screw holes are each provided to upper and lower ends of the respective vibration-proof plate and front panel, and the vibration-proof plate is screw attached to the front panel. The vibration-proof plate has a plurality of hooks that are provided on both sides of its inner surface, and the front panel has a plurality of mating hook holes that are provided on both sides thereof so that the vibration-proof plate is more firmly attached to the front panel. The overall vibration-proof plate is convex to the outside, and at least one vibration-absorbing member is attached to the inner surface of the vibration-proof plate, thus contacting the front panel.

20 Claims, 5 Drawing Sheets

CABINET FOR WASHING MACHINE

BACKGROUND OF THE INVENTION

1. Field of the Invention

The present invention relates to a washing machine. More particularly, the present invention relates to a cabinet for a washing machine having on its front panel a vibration-proof plate which reduces vibration and noise during laundering, and makes the outer appearance of the washing machine better as well as reinforcing the cabinet's strength.

2. Description of the Related Art

Generally, a washing machine performs washing, rinsing and hydroextracting steps by selectively rotating a laundry tub and a pulsator by means of a motor's driving force. The washing step is performed by putting water and laundry into the laundry tub and agitating the tub.

FIG. 1 depicts the internal structure of such a common-type washing machine. As shown in FIG. 1, the washing machine includes a cabinet 10 constituting the outer appearance of the washing machine, a water tub 1 installed in the cabinet 10 and holding a given amount of water required for washing clothes, and a laundry tub 2 rotatably installed in this water tub 1. On the inner bottom of the laundry tub 2 is provided a pulsator 3 that produces water currents for laundering. A driving unit 4 is mounted outside the bottom of the water tub 1 to drive the laundry tub 2 and the pulsator 3.

The driving unit 4 includes a motor 4*a* for generating power, a power transmission unit 4*b* selectively rotating the pulsator 3 and the laundry tub 2 by way of a belt 4*c*. Outside the bottom of the water tub 1 there is provided a drain hose 5 extending to the outside of the cabinet 10 to remove the water in the water tub 1 to the outside.

FIG. 2 is a perspective view of the conventional cabinet 10 for a washing machine.

The conventional cabinet 10 is formed by bending a rust-proof steel plate to a shape of rectangular box and opening the top and the bottom, and includes a front panel 11, a rear panel 12 and both side panels 13. On the top of the cabinet 10 is provided an upper cover 6 having a door 6*a* through which laundry is put into or taken from the washing machine, and a control panel 6*b* on which a user controls the operation of the washing machine, and the condition of the washing machine is displayed. To the bottom of the cabinet 10 is attached a base panel 7 closing the bottom of the cabinet 10 and having a leg at every comer so that the washing machine can be put into a level position.

On the middle of the rear panel 12 of the cabinet 10 there is provided an opening portion 12*a* of rectangular shape through which electric connection to as well as maintaining and repairing of the washing machine are carried out. After completion, the opening portion 12*a* is shut by a cover plate 14.

However, the conventional cabinet 10 that is constituted by bending a slim steel plate cannot effectively prevent vibration and noise from being generated during laundering, and is easily deformed by an outer shock.

Particularly, during the step of hydroextraction, the laundry tub 2 is turned at high speed to remove moisture from the laundry, and the vibration and noise become greater, which is a major complaint of users.

Another drawback with this prior art device is that since the front panel 11 and lower base plate 7 of the cabinet 10 are flat in the overall shape, and since a user's tiptoe cannot come closer than the inside of the lower portion of the washing machine, it is inconvenient to put laundry in the washing machine or take it therefrom.

In addition, since the cabinet 10 is formed of a single steel plate, the front panel 11, positioned in the direction of being easily found by users, has to be in the same color as the other panels, and various changes cannot be applied to the cabinet 10. Accordingly, there is a limit to making the outer appearance of the washing machine better.

SUMMARY OF THE INVENTION

It is an object of the present invention to provide a cabinet for a washing machine having on its front panel a vibration-proof plate that reduces vibration and noise during laundering, and reinforces the cabinet's strength.

It is another object of the present invention to provide a cabinet for a washing machine having a recess on its front lower part thus allowing a user's foot to come closer to the inside of the washing machine's lower part.

It is still another object of the present invention to provide a cabinet for a washing machine having a vibration-proof plate that is attached to its front panel and which may be provided in various colors and shapes to extend the scope of a user's choice.

In order to achieve the above objects, the present invention provides a cabinet for a washing machine with a front panel, both side panels and a rear panel which are all integrally formed, an opened top and an opened bottom, an opening portion formed on the rear panel for electric connection to and maintaining and repairing of the washing machine, and a cover plate for shutting the opening portion, including a vibration-proof plate attached to the front panel to reduce vibrations.

A recess is provided in the vibration-proof plate's lower part, and a recess is formed on the front panel's lower part corresponding to the recess of the plate, thus allowing a user to come closer to the inside of the washing machine.

A plurality of screw holes are each provided to upper and lower ends of the respective vibration-proof plate and front panel, and the vibration-proof plate is screwed to the front panel by its screw holes mating with those of the front panel.

The vibration-proof plate has a plurality of hooks that are provided on both sides of its inner surface and the front panel has a plurality of hook holes that are provided on its both sides, and the hooks each mate with the hook holes so that the vibration-proof plate is more firmly attached to the front panel.

The overall vibration-proof plate is convex to the outside, and there is a gap between the vibration-proof plate and the front panel. At least one vibration absorbing member is attached to the inner surface of the vibration-proof plate, thus contacting the front panel.

The vibration-absorbing member is made of sponge or rubber.

DETAILED DESCRIPTION OF THE PREFERRED EMBODIMENTS

Figure 1:
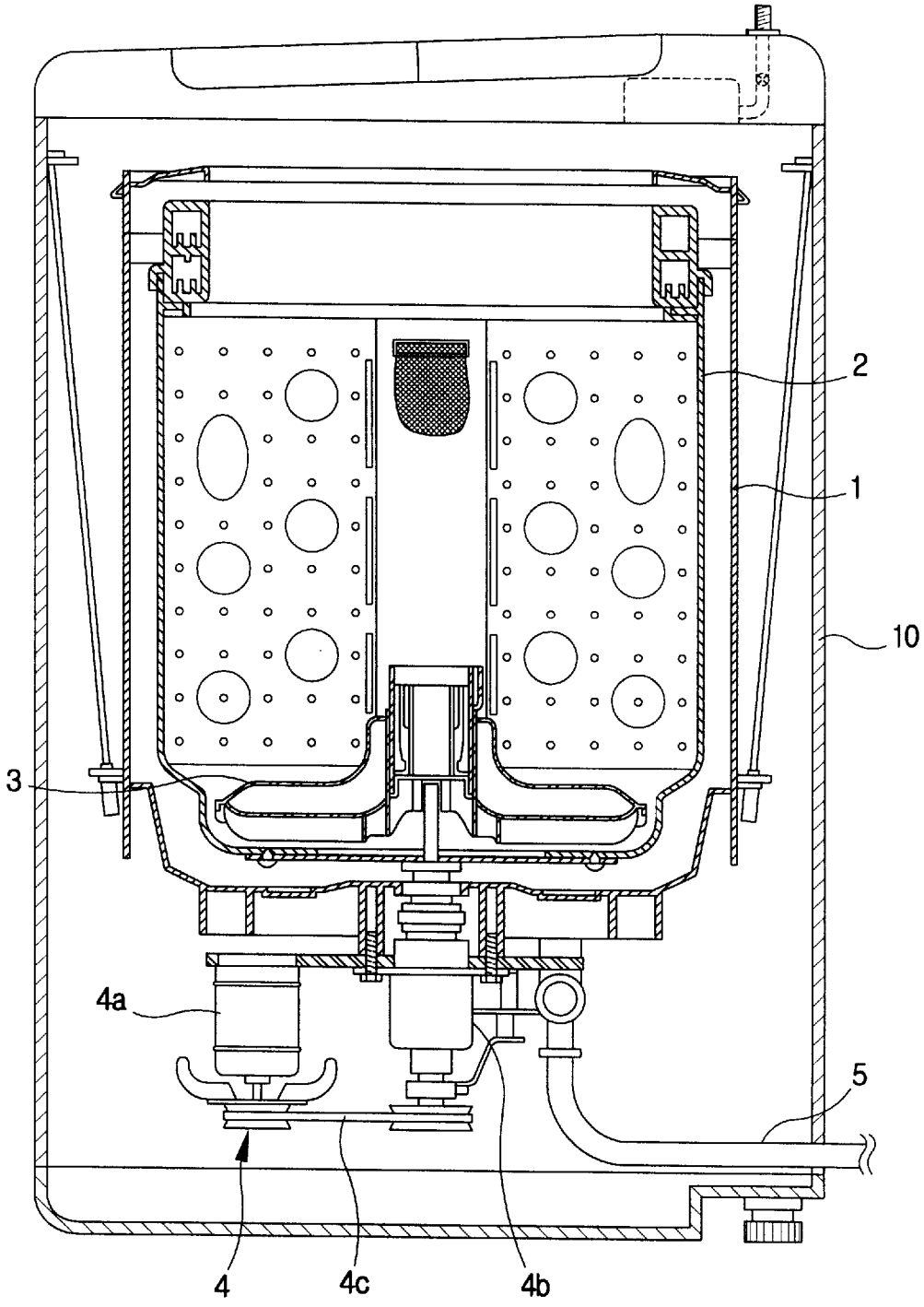
FIG. 1 (PRIOR ART)
FIG. 1 is a side-sectional view of the internal structure of a conventional washing machine.
Figure 2:
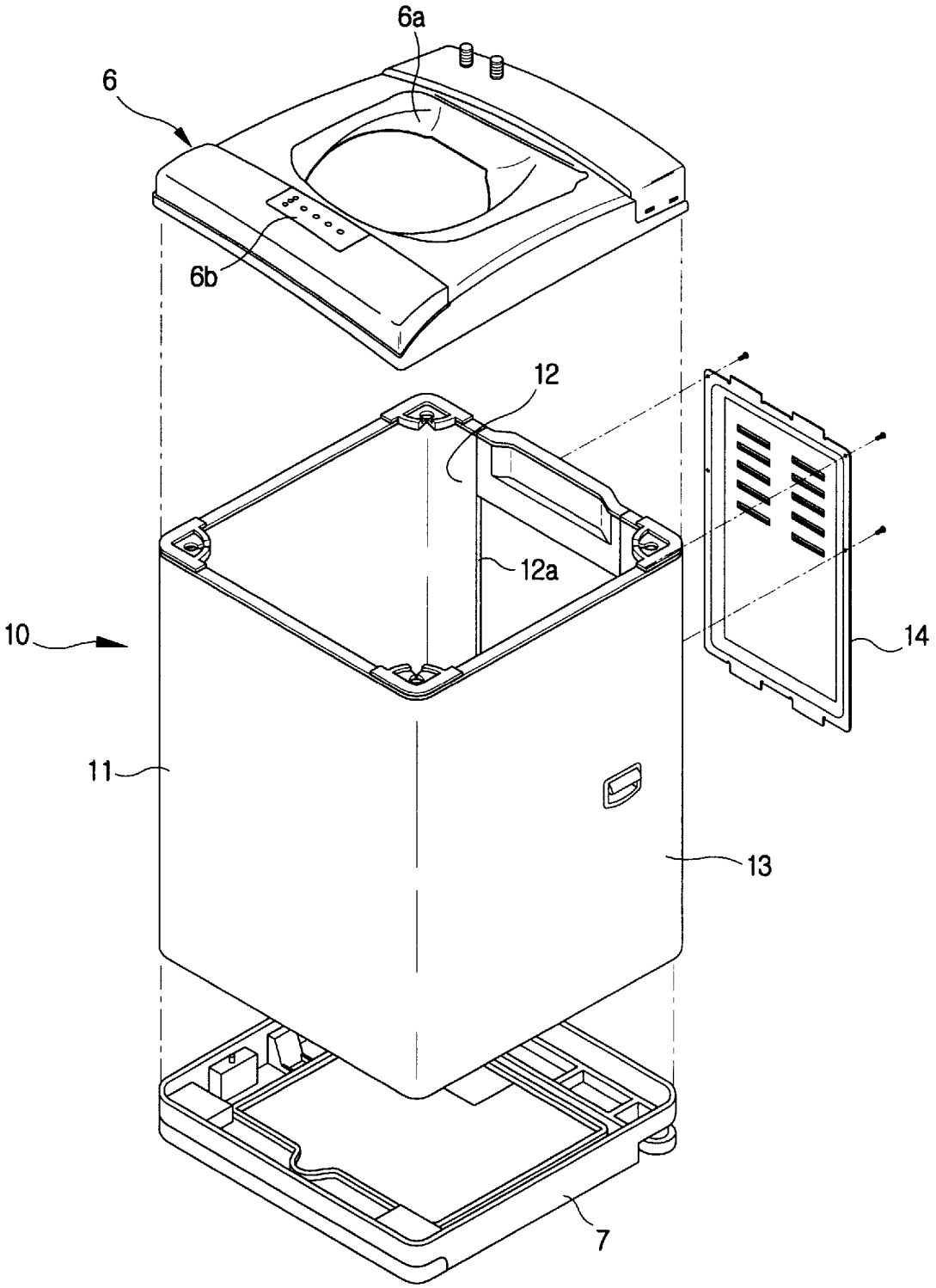
FIG. 2 (PRIOR ART)
FIG. 2 is an exploded-perspective view of a cabinet for the conventional washing machine.

The preferred embodiment of the present invention is now fully described referring to the attached drawings. Like reference numerals denote like reference parts throughout the specification and drawings.

Figure 3:
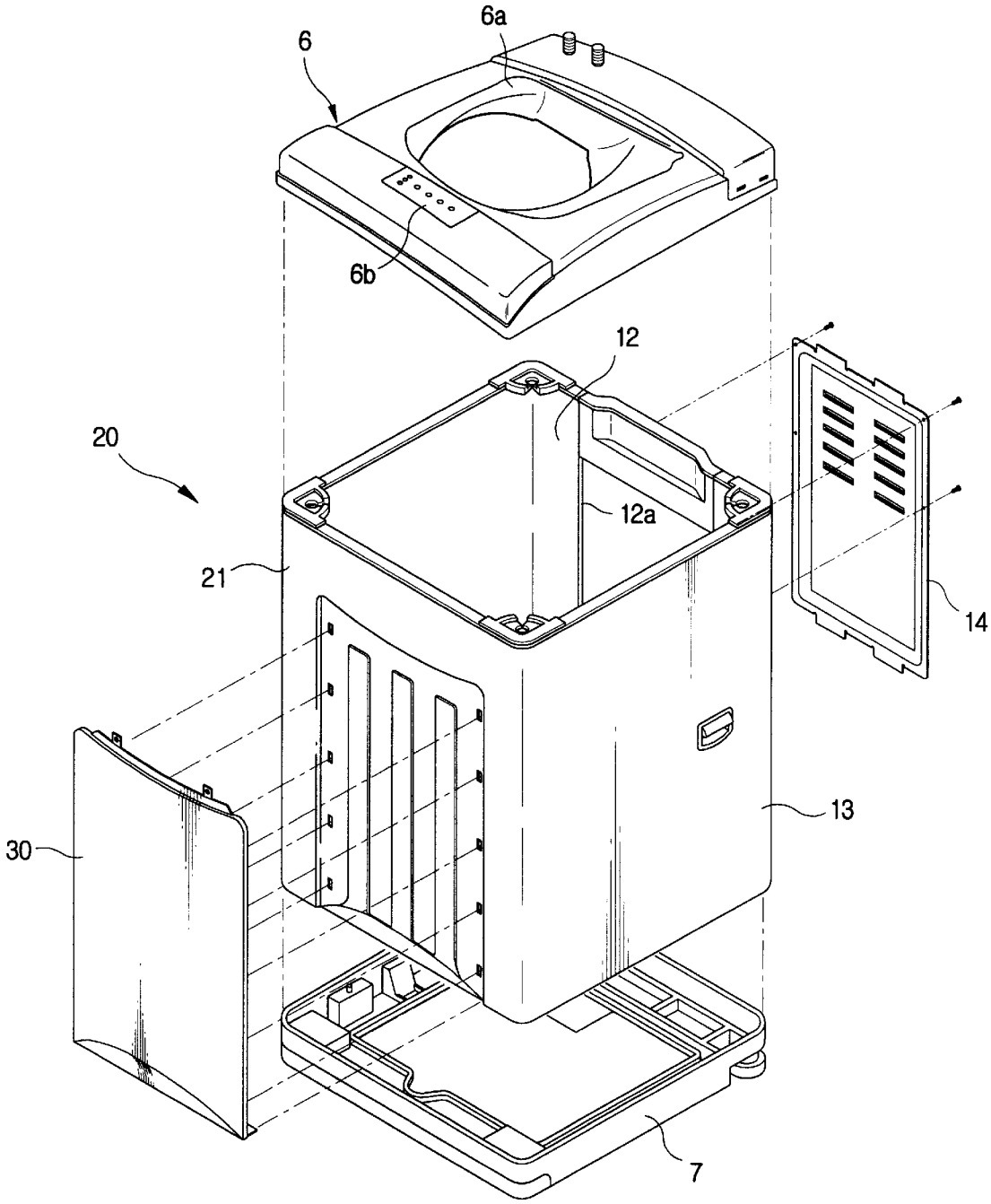
FIG. 3 is an exploded-perspective view of a cabinet for a washing machine with a vibration-proof plate according to the present invention.
Figure 4:
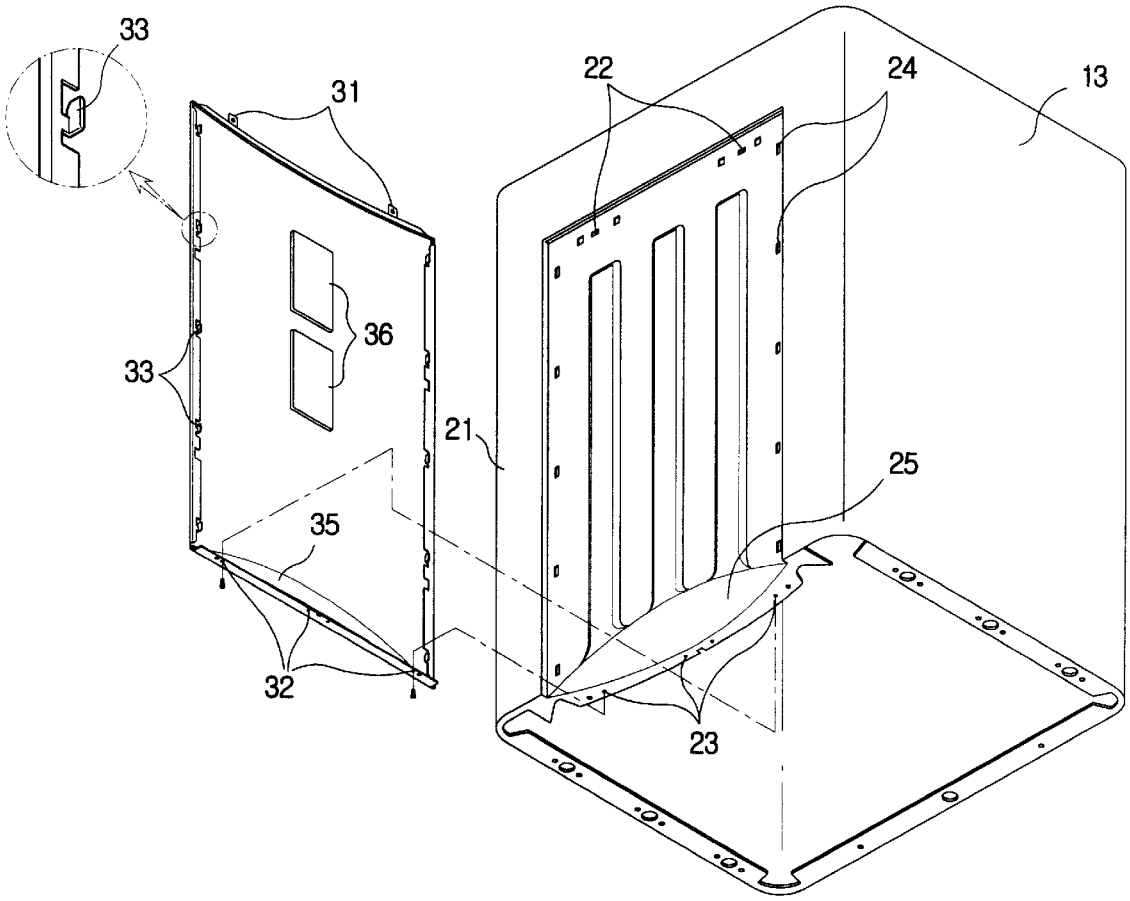
FIG. 4 is a perspective view of the coupling structure of the vibration-proof plate according to the present invention.

FIGS. 3 and 4 are each exploded-perspective views of a cabinet for a washing machine according to the present invention.

As depicted in FIGS. 3 and 4, a cabinet 20 of the present invention further includes a vibration-proof plate 30 attached to its front panel 21.

The inventive vibration-proof plate 30 is made of a thin plate slightly convex to the outside. The plate 30 has screw holes 31 and 32 on its upper and lower ends, and is screwed to the front panel 21 by way of the screw holes 31 and 32 mating with screw holes 22 and 23 of the panel 21. The vibration-proof plate 30 has a plurality of hooks 33 that are vertically provided on both sides of its inner surface extending upward.

On both sides of the front panel 21 there are provided a plurality of hook holes 24 which mate with these hooks 33, respectively. The hooks 33 each mate with the hook holes 24 so that the vibration-proof plate 30 is more firmly attached to the front panel 21. A recess 35 is provided in the lower part of the plate 30, and another recess 25 is formed in the lower part of the front panel 21 corresponding to the recess of the plate 30. Therefore, the front lower part of cabinet 20 is concave to the inside of the washing machine. In order to more reliably reduce vibration and noise during washing, a pair of vibration-absorbing members 36 are attached to the inside of the vibration-proof plate 30. These vibration-absorbing members 36 are made of a material that can absorb vibration and noise very well, preferably a material such as sponge or rubber.

Figure 5:
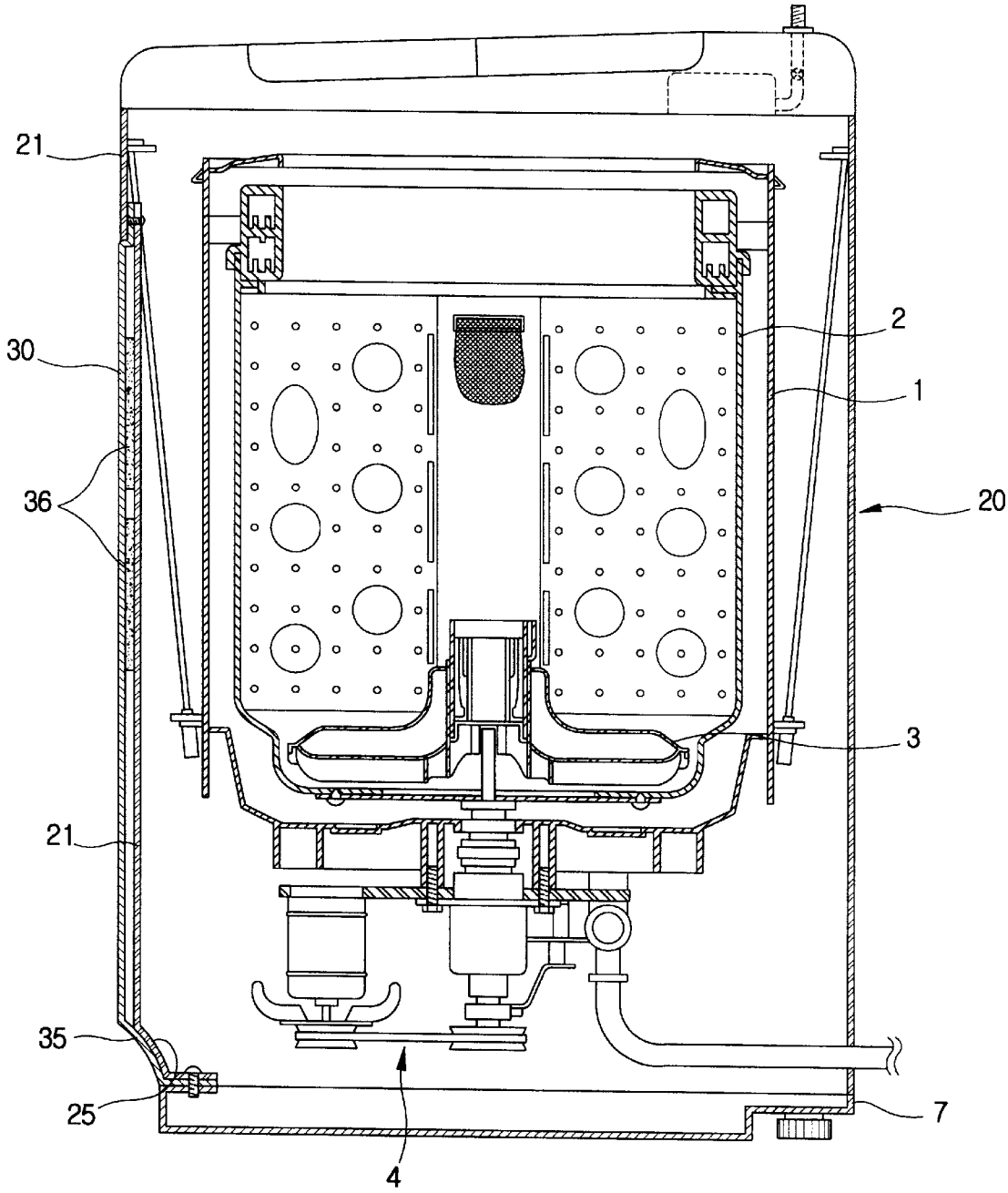
FIG. 5 is a sectional view showing the inventive vibration-proof plate being attached to the cabinet's front panel.

FIG. 5 is a sectional view showing the inventive vibration-proof plate 30 attached to the front panel 21 of the cabinet 20.

As depicted in FIG. 5, the vibration-proof plate 30 is convex to the outside, and when it is being attached to the front panel 21, there is a gap between the plate 30 and the front panel 21. The vibration-absorbing members 36 are thus provided in this gap. The lower part of the cabinet 20 is concave to the inside of the washing machine by the recesses 25 and 35, each recess being provided in the lower part of the front panel 21 and of the vibration-proof plate 30. As described above, since the front of the cabinet 20 is comprised of dual walls, and the vibration-absorbing members 36 are provided between the dual walls, the vibration and noise produced during the operation of the washing machine can be efficiently decreased.

That is, it will be appreciated that the washing machine includes components such as a driving unit 4, a pulsator 3, and a rotating shaft 2 that are turned at high speeds, and that consequently produce vibration and noise. The vibration and noise can be efficiently reduced by attaching the above vibration-proof plate 30 to the front panel 21 of the cabinet 20 and interposing the vibration-absorbing members 36 between the plate 30 and the front panel 21.

In addition, the front surface of the washing machine can be variously changed such as by forming a plurality of wave shapes in all directions instead of making the vibration-proof plate 30 convex to the outside, or by varying the color of the vibration-proof plate 30 as desired, all of which can extend a user's choice and enhance its attraction for consumers.

As described above, the vibration-proof plate attached to the front panel of the cabinet for a washing machine efficiently reduces the vibration and noise produced during the operation of the washing machine, and assures the silent driving of the washing machine.

This vibration-proof plate can reinforce the cabinet's strength, and prevents the front panel from being deformed by an outer shock.

The recesses, each provided to the cabinet's lower part and the vibration-proof plate's lower part, allow a user to come closer to the inside of the washing machine so that a user can put laundry into the washing machine or take it therefrom in a more natural and comfortable posture.

In addition, the vibration-proof plate may be manufactured in various colors, thus making the outer appearance of the washing machine various and better.

What is claimed is:

1. A cabinet for a washing machine comprising:

an integrally formed front panel, side panels and a rear panel, an opened top and an opened bottom, an opening portion formed in the rear panel for electric connection and for maintaining and repairing the washing machine, a cover plate for shutting the opening portion, a vibration-proof plate attached to the front panel to reduce vibrations, and at least one vibration-absorbing member paced between an inner surface of the vibration-proof plate, the at least one vibration-absorbing member contacting the front panel.

2. A cabinet for a washing machine as claimed in claim 1:

wherein a recess is provided in a lower part of the vibration-proof plate, and wherein a recess is formed in a lower part of the front panel corresponding to the recess of said plate, thus allowing a user to come closer to an inside of the washing machine.

3. A cabinet for a washing machine as claimed in claim 1:

wherein a plurality of mating screw holes are each provided to upper and lower ends of the respective vibration-proof plate and front panel, such that the vibration-proof plate is screw attached to the front panel.

4. A cabinet for a washing machine as claimed in claim 3:

wherein the vibration-proof plate includes a plurality of hooks that are provided on both sides of the inner surface thereof, and wherein the front panel includes a plurality of hook holes that are provided on both sides thereof, such that the hooks each mate with respective hook holes so that the vibration-proof plate is more firmly attached to the front panel.

5. A cabinet for a washing machine as claimed in claim 1:

wherein the vibration-proof plate is convex to the outside, and there is a gap provided between the vibration-proof plate and the front panel.

6. A cabinet for a washing machine as claimed in claim 5, wherein the vibration-absorbing member is made of a sponge material.

7. A cabinet for a washing machine as claimed in claim 6, wherein the vibration-absorbing member is made of a rubber material.

8. A cabinet for a washing machine comprising:

an integrally formed front panel, side panels and a rear panel, an opened top and an opened bottom, an opening portion formed in the rear panel for electric connection and for maintaining and repairing the washing machine, a cover plate for shutting the opening portion, a vibration-proof plate attached to the front panel to reduce vibrations, wherein a recess is provided in a lower part of the vibration-proof plate, and wherein a recess is formed in a lower part of the front panel corresponding to the recess of said plate, thus allowing a user to come closer to an inside of the washing machine.

9. A cabinet for a washing machine as claimed in claim 8:

wherein a plurality of mating screw holes are each provided to upper and lower ends of the respective vibration-proof plate and front panel, such that the vibration-proof plate is screw attached to the front panel.

10. A cabinet for a washing machine as claimed in claim 9:

wherein the vibration-proof plate includes a plurality of hooks that are provided on both sides of an inner surface thereof, and wherein the front panel includes a plurality of hook holes that are provided on both sides thereof, such that the hooks each mate with respective hook holes so that the vibration-proof plate is more firmly attached to the front panel.

11. A cabinet for a washing machine as claimed in claim 10:

wherein the vibration-proof plate is convex to the outside, and there is a gap provided between the vibration-proof plate and the front panel.

12. A cabinet for a washing machine as claimed in claim 11:

wherein at least one vibration-absorbing member is attached to the inner surface of the vibration-proof plate and contacts the front panel.

13. A cabinet for a washing machine as claimed in claim 12, wherein the vibration-absorbing member is made of a sponge material.

14. A cabinet for a washing machine as claimed in claim 13, wherein the vibration-absorbing member is made of a rubber material.

15. A cabinet for a washing machine comprising:

an integrally formed front panel, side panels and a rear panel, an opened top and an opened bottom, an opening portion formed in the rear panel for electric connection and for maintaining and repairing the washing machine, a cover plate for shutting the opening portion, a vibration-proof plate attached to the front panel to reduce vibrations, and wherein a plurality of mating screw holes are each provided to upper and lower ends of the respective vibration-proof plate and front panel, such that the vibration-proof plate is screw attached to the front panel.

16. A cabinet for a washing machine as claimed in claim 15:

wherein the vibration-proof plate includes a plurality of hooks that are provided on both sides of an inner surface thereof, and wherein the front panel includes a plurality of hook holes that are provided on both sides thereof, such that the hooks each mate with respective hook holes so that the vibration-proof plate is more firmly attached to the front panel.

17. A cabinet for a washing machine as claimed in claim 15:

wherein the vibration-proof plate is convex to the outside, and there is a gap provided between the vibration-proof plate and the front panel.

18. A cabinet for a washing machine as claimed in claim 17:

wherein at least one vibration-absorbing member is attached to the inner surface of the vibration-proof plate and contacts the front panel.

19. A cabinet for a washing machine as claimed in claim 18, wherein the vibration-absorbing member is made of a sponge material.

20. A cabinet for a washing machine as claimed in claim 19, wherein the vibration-absorbing member is made of a rubber material.

* * * * *